United States Patent [19]

Saunders

[11] Patent Number: 4,584,859

[45] Date of Patent: Apr. 29, 1986

[54] IN-LINE CONTROL DURING DRAW-REDRAW OF ONE-PIECE SHEET METAL CAN BODIES

[75] Inventor: William T. Saunders, Weirton, W. Va.

[73] Assignee: Weirton Steel Corporation, Weirton, W. Va.

[21] Appl. No.: 768,708

[22] Filed: Aug. 23, 1985

[51] Int. Cl.[4] ..... B21D 22/00

[52] U.S. Cl. ..... 72/43; 72/349; 72/405

[58] Field of Search ..... 72/39, 41, 43, 44, 45, 72/347–349, 405

[56] References Cited

U.S. PATENT DOCUMENTS

| | | | |
|---|---|---|---|
| 3,845,539 | 11/1934 | Yamagishi | 72/45 |
| 3,908,429 | 9/1975 | Gram | 72/349 |
| 3,945,231 | 5/1976 | Imazu | 72/349 |
| 4,223,544 | 9/1980 | Main | 72/45 |
| 4,364,255 | 12/1982 | Byrd | 72/345 |
| 4,454,743 | 6/1984 | Bulso | 72/349 |
| 4,503,213 | 3/1985 | Phalen | 72/349 |
| 4,503,702 | 3/1985 | Bulso | 72/349 |

*Primary Examiner*—Leon Gilden
*Attorney, Agent, or Firm*—Raymond N. Baker

[57] ABSTRACT

Continuous in-line control of work product is provided in draw-redraw processing of flat-rolled sheet metal, coil coated on both its surfaces with organic coating, to finished one-piece can bodies. Drawing of a sheet metal blank is controlled to present flange metal at the open end of the cup-shaped work product which is disposed with its closed end wall in the sheet metal line. The drawn work product is pneumatically controlled to separate the sheet metal line from the can line eliminating random accumulation of work product. Redrawing operations are carried out closed end up to present flange metal which stabilizes in-line movement of work product. Electrostatic lubrication to protect organic coating and facilitate forming is carried out prior to each redrawing operation; in-line movement of work product is controlled during such lubrication. Final redrawing and countersinking of an end wall profile are carried out at a single station with timing control of separate functions while avoiding time delay and damage to can body sheet metal due to such end wall countersinking.

6 Claims, 15 Drawing Figures

IN-LINE CONTROL DURING DRAW-REDRAW OF ONE-PIECE SHEET METAL CAN BODIES

This invention relates to draw-redraw fabrication of one-piece sheet metal can bodies for assembly of cylindrical two-piece cans for food and beverage products. More specifically, this invention is concerned with draw-redraw processing of coated flat-rolled sheet metal from continuous strip can stock to finished can bodies with in-line control of work product throughout a continuous production-type can body fabricating line.

The present invention is particularly directed to fabrication of flat-rolled steel, coil coated on both its surfaces with an organic coating, into one-piece can bodies for direct use in assembly of two-piece sanitary cans.

Three-piece sanitary cans manufactured from flat-rolled steel set the standard for can fabricating economy for many years. Objections to the side wall seam and, more recently, specific objections to the lead content of the side wall seam solder, stimulated concerted efforts over a period of more than a decade in attempting to find suitable processing which would enable economic manufacture of a competitive two-piece can. While shallow depth and other two-piece sanitary cans have been made and used, prior art one-piece can body fabrication processes have not been as economical as three-piece can assembly methods especially for deep-drawn can bodies requiring more than one draw forming operation.

The fabrication rate of acceptable one-piece can bodies is an important factor in the competition between differing can-making technologies. Can handling methods in previously available draw-redraw or draw-iron-redraw processing presented obstacles to achieving desired production rates. For example, in prior draw-redraw art, after cutting a blank and drawing a shallow depth cup, such work product was accumulated randomly and special measures had to be taken to reestablish properly oriented movement of the cup-shaped work product in the can-making line. Work product control was thus interrupted at an early forming stage adversely affecting productivity. Further, such random accumulation of shallow-drawn cups often resulted in damage to the work product or its coating. Also, coordinated in-line movement was delayed or made more difficult in prior draw-redraw or draw-iron-redraw processing by operations required to be carried out at stations separate from cup forming stations such as bottom wall profiling or flange metal orientation.

The present invention overcomes various obstacles of the prior art by achieving and maintaining control of work product throughout a can body fabrication line. For example, flange metal, properly oriented, is established during initial cupping and maintained throughout the can body fabricating line; this contributes to stabilized handling during in-line movement of work product.

Also, to enable multiple forming operations to be carried out without damage to the organic coating pre-applied to both surfaces of the sheet metal, the invention teaches lubricating both surfaces of the work product before each draw or redraw forming operation and carrying out such lubrication during controlled in-line movement of work product.

With the present invention, controlled movement of work product is provided from blanking of flat-rolled sheet metal through fabrication of the final can body configuration ready for filling and closure.

These and other advantages, contributions and features of the invention are described more specifically in relation to the accompanying drawings, in which.

In the draw-redraw processing taught by the present invention, a blank is cut from continuous strip sheet metal which has been coated on both its planar surfaces with an organic coating. The cut blank is drawn into a shallow-depth, large-diameter cup-shaped work product in a manner to establish unitary flange metal at the open end of the cup.

Establishing flange metal during cupping and maintaining flange metal throughout can body fabrication eliminates interruption of in-line work product control for separate flange metal forming or orienting steps, e.g. as required by one-piece can body fabrication methods which drive the work product through die cavity tooling. Another advantage is that such flange metal holds the side wall of a cup-shaped work product in a cylindrical configuration with its side wall symmetrically spaced from the central longitudinal axis of the cup; this facilitates access of tooling into the inside of the cup-shaped work product in subsequent processing which, among other contributions, helps to prevent damage, otherwise likely to occur with non-round work product, during such subsequent processing. In addition, the flange metal contributes to work product stability for in-line movement and orientation during processing steps.

Further, in the processing taught, the travel path of sheet metal scrap, after passage through a blanking and cupping station, is automatically separated from the work product travel path in the can line while maintaining in-line control and movement of oriented work product and eliminating random accumulation of non-oriented work product as utilized in prior one-piece can body fabricating lines.

Redrawing of a drawn cup-shaped work product to a smaller diameter and increased side wall height is carried out in a manner to present unitary flange metal around the open end of the cup-shaped work product at each station. In accordance with the invention, upon completion of each redraw, the work product is properly disposed with such flange metal in the pass lihe for continued in-line movement. Redraw processing can include multiple redraws; however, the closed end wall of the can body is countersunk and profiling impressed at the final redraw station.

Figure 1:
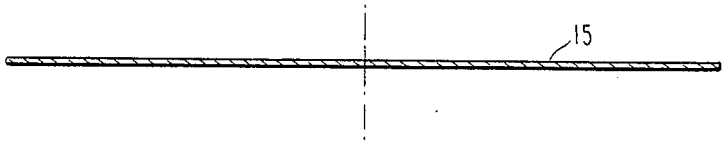
FIGS. 1 through 5 are cross-sectional presentations of work product showing configuration and orientation during draw-redraw fabrication of a one-piece body in accordance with the invention.
Figure 2:
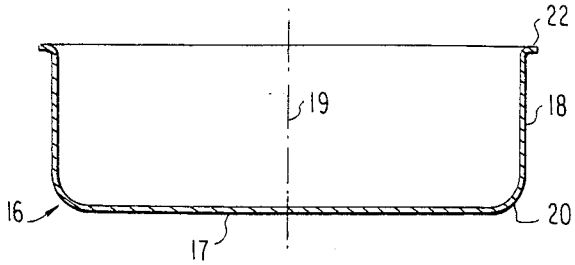

Referring to FIGS. 1 through 5, circular blank 15 of FIG. 1 is cut from elongated, continuous-length flat-rolled sheet metal previously coated on both its surfaces with an organic coating. Cut blank 15 is then drawn, open-end up, into a cup-shaped work product 16 (FIG. 2) at a single blanking and cupping station.

Cup 16 includes a planar closed end wall 17 and cylindrical configuration side wall 18 extending toward its remaining open end in symmetrical relationship to its central longitudinal axis 19. Compound curvilinear transition zone 20 joins end wall 17 and side wall 18.

In accordance with the invention, the draw stroke in forming cup 16 is controlled so as to establish unitary flange metal 22, which lies in a transverse plane substantially normal to the central longitudinal axis 19; such flange metal provides proper side wall orientation protecting the cup 16 during subsequent processing and provides a work surface for in-line movement and proper can body orientation for subsequent processing.

Figure 3:
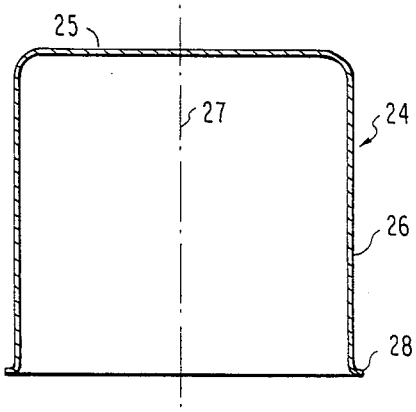
Figure 4:
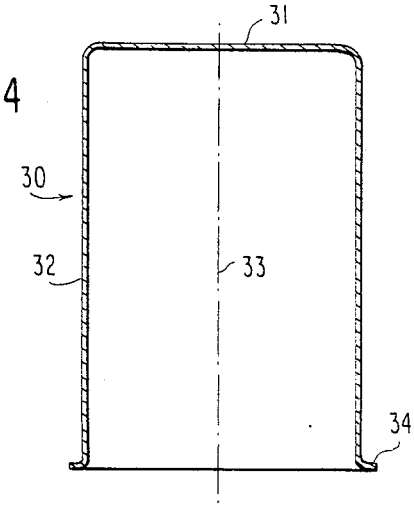
Figure 5:
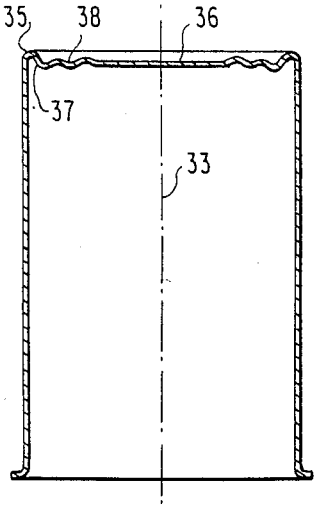

The shallow-depth cup 16 is promptly inverted to the orientation shown in FIGS. 3 and 4 for redraw processing. Unitary flange metal is presented at the completion of each redraw operation facilitating controlled conveyance of work product which is oriented closed end up for each redraw.

A first redraw can body 24 (FIG. 3) includes unitary end wall 25 and cylindrical configuration side wall 26; the side wall is symmetrically spaced in relation to central longitudinal axis 27. Flange metal 28 at the open end of the can body lies in a plane which is substantially normal to such centerline longitudinal axis. A second redraw can body 30 (FIG. 4) presents end wall 31 and cylindrical configuration side wall 32 which is symmetrically spaced from center longitudinal axis 33. Flange metal 34 is presented at the open end of the can body 30 and lies in a plane which is substantially normal to such centerline axis.

While first redraw (FIG. 3) and final redraw (FIG. 4) can bodies are shown, the invention is applicable to a single redraw or other multiple redraw processing.

However, in accordance with present teachings, as part of the final redraw operation, closed end wall 31 of can body 30 is countersunk in relation to end wall periphery 35 (FIG. 5) to provide a recessed panel 36; final redraw and countersinking of the end wall are carried out at a single station with timing arrangements which avoid damage to work product sheet metal. Countersunk wall portion 37 extends between recessed panel 36 and periphery 35; circular profiling ribs, such as 38, are radially spaced inwardly of wall portion 37. Such end wall configuration can be in accordance with that shown in U.S. Pat. No. 4,120,419 of Oct. 17, 1978 which is included herein by reference. Countersinking of the closed end of the can body enables the center of end wall panel 36 to move inwardly and outwardly, under vacuum or pressure conditions in an assembled can, along the centerline axis 33. Such movement can occur without disturbing the stability of a can body when in its upright position for filling; the can body is inverted from the orientation shown in FIG. 5 for purposes of filling.

Such countersinking of the closed end wall is carried out at the same station as final redraw with preselected timing of tooling so as to avoid damage to the redrawn can. Separate handling of work product at another station for such end wall countersinking and reinforcing rib profiling is eliminated.

Figure 6:
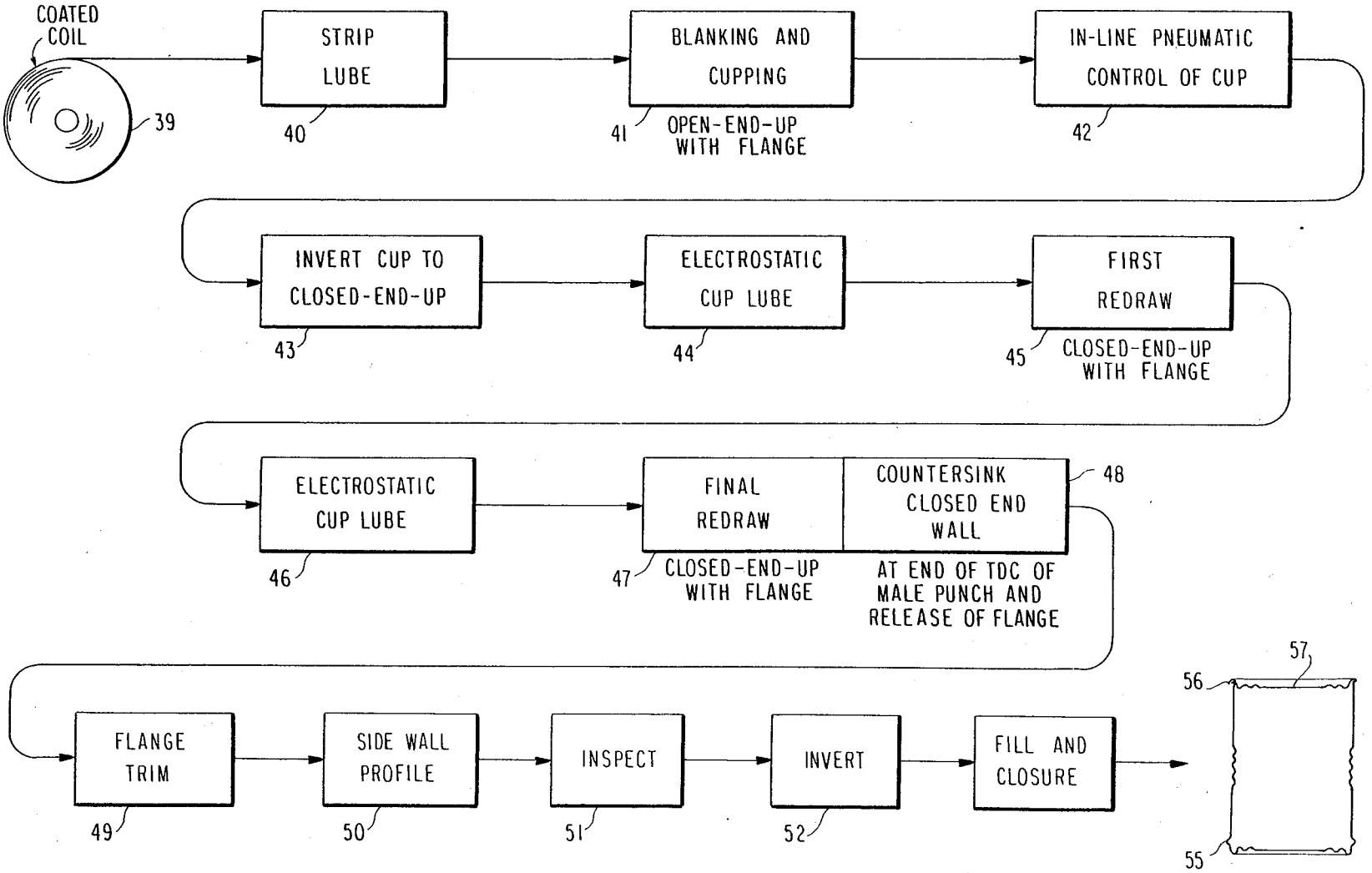
FIG. 6 is a box diagram presentation of in-line draw-redraw processing of organic coated flat-rolled sheet metal to final can body configuration for completion of two-piece sanitary cans in accordance with the invention.

The sequence for converting coil coated flat-rolled sheet metal into unitary can bodies for direct assembly (without coating repair or cleansing requirements) into cylindrical sanitary cans is depicted diagrammatically by FIG. 6. Continuous-strip sheet metal, coated on both surfaces with an organic coating, is lubricated on both such organically coated planar surfaces as fed from coil 39 prior to entry into a blanking and cupping operation; a strip lube station 40 can be utilized for this purpose. A lubricant, such as petrolatum, which is FDA approved for use within food cans, is used throughout can body processing.

Blanking and cupping are carried out in a single station 41; cupping is carried out open end up to facilitate movement of the cup into the can line. After cup formation, the sheet metal line is separated from the work product line to prevent interference with or delay of work product travel. The shallow-drawn cup is pneumatically controlled (42) for such purposes.

The open-end up shallow-depth cup is inverted to closed-end up orientation (43) and electrostatically lubricated at cup lubrication station 44; such cup can be lubricated before or after inverting but prompt inverting to closed-end up orientation after open-end up cupping is preferred.

First redraw at station 45 is carried out with the can body closed end-up; the redraw stroke is controlled to present unitary flange metal about the open end of the work product as redraw is being completed.

Electrostatic lubrication of both interior and exterior surfaces before redraw facilitates forming and avoiding damage to the organic coating. In the specific embodiment of FIG. 6, a first redraw is followed by electrostatic cup lubrication at cup lubricator 46 prior to final redraw at station 47. Single or multiple redraw processing can be provided. The end wall countersinking step 48 is carried out in the final redraw press with timing provisions, as described in relation to later figures, to prevent damage to work product sheet metal. Upon completion of redraw and countersinking of the closed end wall, the flange metal is trimmed (49) and reinforcing side wall profiling is impressed (50). Can body inspection may be carried out at station 51. The can body is inverted (52) to provide a one-piece can body properly oriented for filling and closure. Side wall profiling and inspection can be carried out after inverting while maintaining the in-line control taught by the invention.

Chime rib 55, in the side wall contiguous to the closed end wall as shown in FIG. 6, presents a can body diameter which is substantially the same as that of seam 56 at the open end of the can body. Seam 56 secures closure 57 to the open end of the one-piece can body as fabricated.

Figure 7:
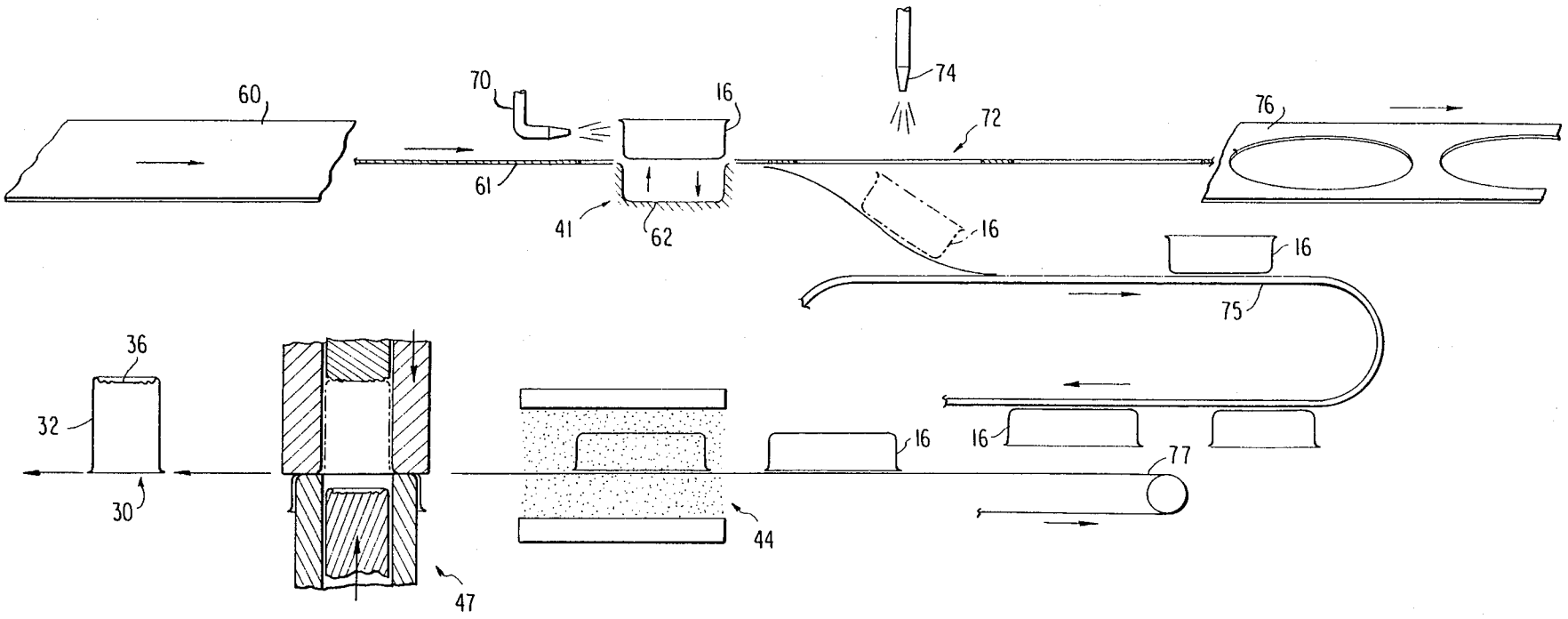
FIG. 7 is a schematic view, partially in perspective and partially in cross section, of a continuous in-line control, draw-redraw processing line embodying the invention.

Referring to FIG. 7, lubricated organically-coated continuous strip 60 (shown initially in perspective) is fed horizontally along travel path 61 for sheet metal to blanking and cupping station 41. Movement of the sheet metal is cyclically controlled with a circular blank of predetermined diameter being cut during cyclic interruption in the forward movement of the sheet metal. At the blanking and cupping station 41, the blank is drawn, open end up, in a female die cavity 62 and the shallow-depth cup 16 is ejected from the die cavity.

Figure 8:
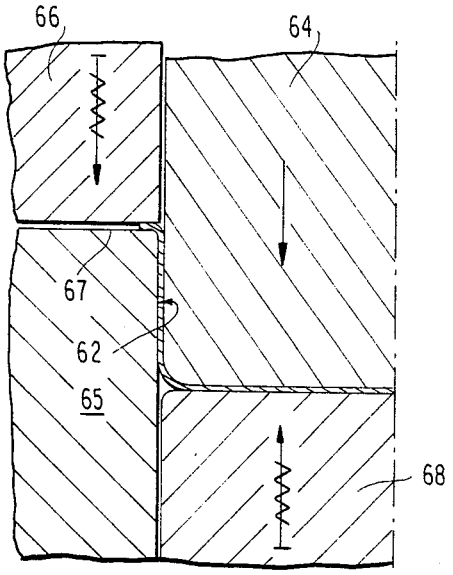
FIGS. 8 and 9 are cross-sectional partial views of tooling for carrying out a draw operation in accordance with the invention.
Figure 9:
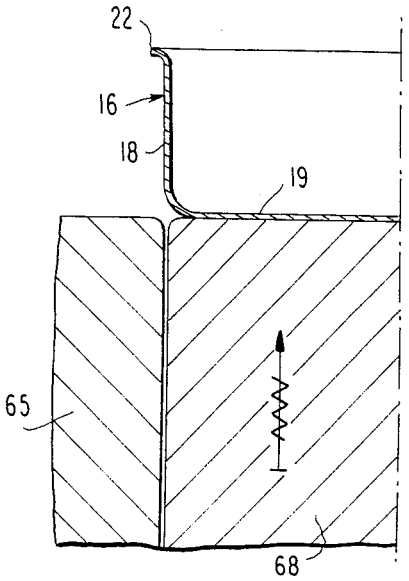

In the specific embodiment of cupping apparatus shown in the cross-sectional partial views of FIGS. 8 and 9, the cut blank is drawn by relative movement of a draw punch 64 into the cavity defined by fixed draw die tool 65. Sheet metal peripheral to the cavity is clamped between clamping ring 66, which is pneumatically, hydraulically or spring loaded, and the upper clamping surface 67 of draw die 65 (FIG. 8). Press structures for blanking and cupping in a single stroke are commercially available; however, in accordance with present teachings, the downward stroke of draw punch 64 is controlled to establish flange metal 22 (FIG. 9) at the open end of cup 16.

In FIG. 9, spring-loaded ejector 68 has ejected the cup 16 from the draw die 65 placing the closed cup end wall 17 in the sheet metal travel path 61; the metal strip, as provided, is then cycled forward for the next blanking and cupping operation.

Cupping open-end up places closed end wall 17 in the pass line which facilitates the pneumatic movement of work product contributed by present teachings.

In the illustrated embodiment provided for separation of the work product travel path from the sheet metal (scrap) path, horizontally directed pneumatic nozzle 70 (FIG. 7) moves cup 16 in the forward direction along the travel path 61 of the sheet metal in the direction of previously cut blank openings such as 72. Vertically-directed pneumatic nozzle 74 then moves the cup 16 downwardly through blank opening 72; that is, the drawn cup 16 is moved through the opening in the sheet metal formed by the cut blank from which cup 16 was formed. Such vertically downward movement can be carried out preferably during cyclic interruption in strip movement for the next blanking and cupping operation. Cup 16 is moved to conveyance means, such as conveyor 75, on which in-line movement of the vertically oriented cup is controlled, e.g. magnetically when working with cups made from flat-rolled steel.

Remaining sheet metal strip 76 with cut blank openings (shown in perspective) moves from the exit side of the blanking and cupping station 41 along the sheet metal travel path for accumulation as scrap. Separation of the sheet metal travel path from the work product can line, while maintaining in-line oriented control of work product, comprises an important contribution to the continuous in-line control of work product; random accumulation of work product and the separate handling requirements which hindered prior processing and productivity are avoided. Such separation can also be carried out by mechanically directing the scrap metal downwardly while the drawn cup is moved pneumatically into a can line extending along a path approximating that of the sheet metal feed line.

In the specific embodiment of FIG. 7, conveyor 75 moves the shallow cups so that they are inverted by being transferred to conveyor 77 for continuing in-line control and movement of the work product, properly oriented with closed end up for redraw, along the can-making line. The cups are lubricated by passage through electrostatic cup lubricator station 44 and fed to a redraw station. A final redraw station 47 is shown in FIG. 7 in which the final redraw can body 30, with side wall 32 and countersunk end wall panel 36, is formed.

As shown schematically in FIG. 7, controlled in-line movement of the work product through the line is maintained at all times. Random accumulation of non-oriented cup-shaped work product is eliminated with the above described cup transfer steps and apparatus.

Closed-end up orientation promptly after cupping is preferred for cleanliness of the can body interior to avoid gravitation deposit of undesirable matter within the can body. Also, closed-end up orientation enables selection of redraw apparatus which facilitates desired placement of the redrawn cup in the pass line upon completion of the redraw operation without requirements for ejection from a draw cavity.

Establishing and maintaining flange metal facilitates such pass line disposition of the cup-shaped work product by providing an extended surface area for stable orientation of the cup shape. Such teachings contribute to in-line control and also improve movement rate over that which would otherwise be available if it were necessary to accumulate redrawn cups below the pass line and/or provide for ejection to return cups to the pass line after a forming operation.

These and other advantages are achieved by combining, in the processing line, redraw press action in which the redraw punch tooling and the redraw die tooling can move in opposite directions in relation to each other simultaneously during at least a major portion of the redraw stroke. Also, the redraw press action is selected so that the redraw punch and the redraw die are removed vertically, in opposite directions, to provide clearance for prompt movement of vertically oriented work product along the pass line as forming is completed. Tooling configurations and timing, as described later herein, provide the desired amount of simultaneous opposite direction movement so as to minimize the overall vertical stroke dimension of the press thus decreasing stroke time and improving production rate capabilities of the processing line. Redraw press structure, per se, to enable selection of timing and direction of movement of male and female tooling, as taught herein, is available from Standun Inc., Rancho Dominquez, California 90221.

A specific embodiment of redraw tooling utilizes a redraw die presenting a redraw cavity circumscribed by a planar clamping surface, a redraw punch, a toroidal clamping ring presenting an upper planar clamping surface circumscribing the redraw punch, and a male profiling member; each has a common central axis. The male profiling member is fixed; the redraw die, the male punch and clamping ring are capable of vertical movement parallel to such central axis; the redraw die and the redraw punch are driven and the clamping ring is pneumatically, hydraulically, or spring loaded.

FIGS. 10 through 15 depict a final redraw of cup-shaped work product 24 with countersinking of the end wall upon completion of redraw; however, the redraw steps described are applicable to a first or intermediate redraw.

Figure 10:
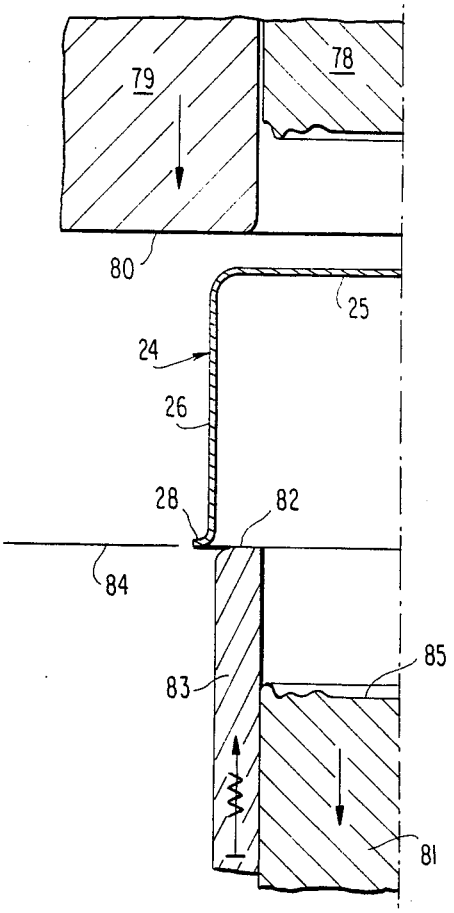
FIGS. 10 through 15 are cross-sectional partial views of tooling for carrying out redraw operations including final redraw with end wall countersinking in accordance with the invention.

As shown in FIG. 10, such tooling is clear of the pass line so that work product 24 can be moved horizontally along the pass line into position for redraw. Male profile member 78 is fixed; a spring-loaded can body release ring (not shown) can circumscribe male profiling member 78. Draw die 79 presenting planar clamping surface 80 is near the upper end of its stroke as the work product is positioned for redraw, downward movement being initiated.

Redraw punch 81 is moving downwardly, as part of the previous operation, nearing the bottom of its stroke. Planar clamping surface 82 of clamping ring 83 is in the pass line 84. The upper profiled surface 85 of punch 81 is below the pass line. Work product 24 is in position with its flange metal 28 disposed in the pass line.

Figure 11:
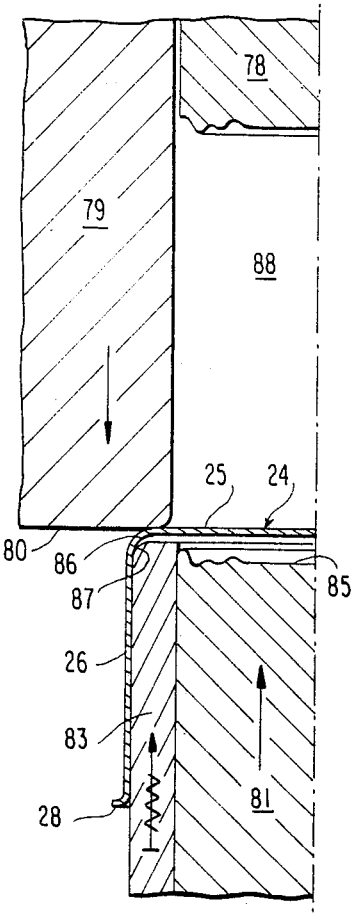

As shown in FIG. 11, the planar clamping surface 80 of downwardly moving draw die 79 has moved the work product below the pass line onto the clamping ring 83. The larger radius transition zone 86 between the end wall 25 and side wall 26 of work product 24 is in position to be reshaped around the transition zone 87 of the clamping ring 83 by continued downward movement of draw die 79.

Figure 12:
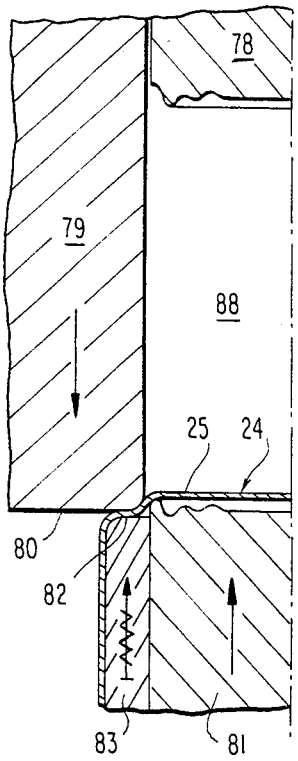
Figure 13:
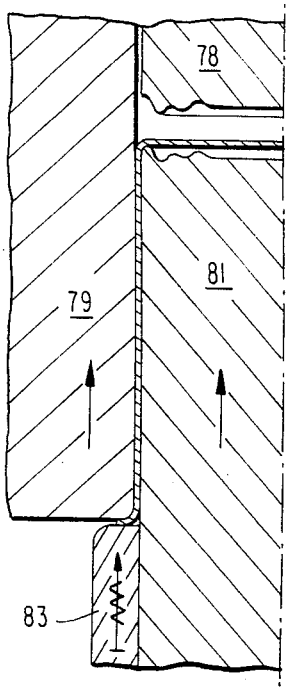

As shown in FIG. 12, such reshaping has been completed and the metal which is peripheral to upwardly moving redraw punch 81 is being clamped between the planar clamping surface 80 of draw die 79 and upper planar surface 82 of clamping ring 83; such clamping is free of nesting curvlinear clamping surfaces as taught in the prior art.

The new diameter is redrawn with draw die 79 moving downwardly initially while redraw punch 81 is simultaneously moving upwardly into the redraw cavity 88 during a major portion of the redraw.

As the redraw is approaching completion (FIG. 13), the redraw die 79 and redraw punch 81 are moving in the same direction with redraw punch 81 moving at a faster rate. Redraw forming is controlled to present flange metal before release of clamping action.

Figure 14:
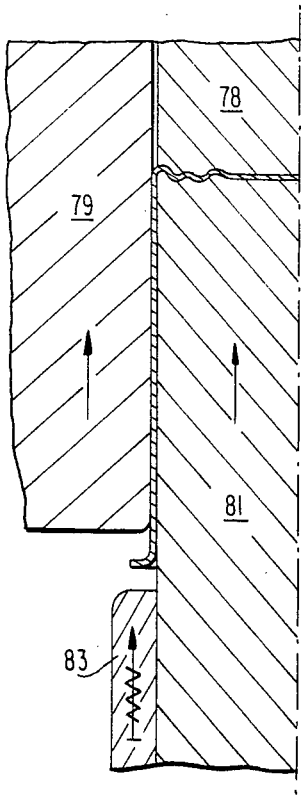

As shown in FIG. 14, clamping action has been released as draw die 79 moves upwardly. Redraw punch 81, as clamping action is released, approaches and reaches top dead center of its upward stroke countersinking the end wall in cooperation with fixed male profile member 78. Such countersinking takes place through movement of side wall metal; prior release of clamping action is provided to avoid damage to the sheet metal due to such movement. Draw punch 81 is then withdrawn downwardly.

Figure 15:
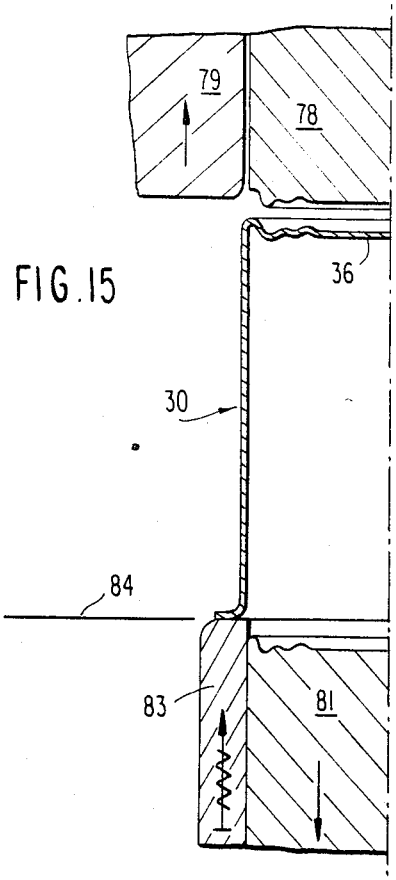

As shown in FIG. 15, upon completion of redraw forming and end wall countersinking operations, the upper planar clamping surface 82 of clamping ring 83 is positioned in the pass line 84 to support flange metal at the open end of the work product providing for movement in the pass line for exit from the press. Redraw punch 81 is moving downwardly below the pass line and redraw die 79 is moving upwardly above the closed end of the redrawn can body. Specific redraw tooling configurations for use in the present invention are described in more detail in assignee's copending application Ser. No. 712,238 "DRAWN CAN BODY METHODS, APPARATUS AND PRODUCTS", which is included herein by reference.

In-line flange trimming to provide uniform diameter flange metal can be carried out by apparatus as described in U.S. Pat. No. 4,404,836 "METAL CONTAINER EDGE TRIMMING METHOD AND APPARATUS", which is included herein by reference.

Electrostatic cup lubrication before each redraw operation is carried out during controlled in-line movement of the work product; electrostatic lubrication apparatus for such cup lubricating purposes is described in assignee's copending application Ser. No. 681,630 "ELECTROSTATIC LUBRICATION OF CUP-SHAPED CAN BODIES" which is included herein by reference.

Apparatus 50 (FIG. 6) for in-line side wall beading is available from Metal Box Limited, Reading RGl 3JH England.

Apparatus 51 (FIG. 6) for in-line inspection of can bodies is available from Borden, Inc., Randolph, N.Y. 14772.

Dimensional values for draw-redraw fabricating a 211×400 size can from 65 #/bb flat-rolled steel are as follows:

| Work Product | Diameter | Side Wall Height |
|---|---|---|
| Sheet metal blank | 6.7" | — |
| Shallow cup 16 | 4.4" | 1.5" |
| First-redraw cup 24 | 3.2" | 3" |
| Second-redraw cup 30 | 2.6" | 4" |

Typical sheet metal clearance in each draw forming is approximately 1.5×metal thickness; e.g. about 0.010" to 0.012" per side (in cross section) for 65 #/bb flat-rolled steel.

Can bodies processed in accordance with the invention in the range of from about two to about four and one-quarter inches in diameter and, in the range of about one to about five inches in height, utilize flat-rolled steel of about fifty to about one hundred and ten #/bb (nominal thickness gage of about 0.005" to about 0.012") or flat-rolled aluminum of nominal thickness gage between about 0.005" and about 0.015".

While specific data on materials, dimensions and configurations have been set forth in describing embodiments of the invention, other values are available in the light of the above teachings while utilizing the novel concepts presented; therefore, for purposes of determining the scope of the invention, reference shall be had to the appended claims.

I claim:

1. Method for making one-piece can bodies utilizing draw-redraw forming of flat-rolled sheet metal while maintaining control of orientation and movement of cup-shaped work product throughout a can-making line, comprising in combination the steps of providing continuous-length flat-rolled sheet metal of predetermined thickness gage coated on both its planar surfaces with an organic coating, such organic coating surfaces being coated with draw-lubricant;

establishing a horizontally oriented sheet metal travel path for longitudinal movement of such flat-rolled sheet metal in the direction of its continuous length into and out of a blanking and cupping station;

feeding such sheet metal in substantially planar form in the direction of its continuous length by providing for cyclic longitudinal movement of such sheet metal through such blanking and cupping station for repetitious blanking and cupping operations during cyclic interruptions in longitudinal movement of continuous-length sheet metal along such sheet metal travel path;

carrying out a blanking and cupping operation which includes:

cutting a circular blank of predetermined diameter from sheet metal, then draw forming such cut blank into a cup-shaped work product having its open end oriented upwardly by relative movement from opposite planar surfaces of such cut blank of a draw punch with respect to a draw die defining a draw cavity into which such sheet metal is drawn, such drawn work product having a closed end wall, a cylindrical configuration unitary side wall extending toward its remaining opposite open end of such drawn cup and a compound curvilinear transition zone joining such closed end wall and cylindrical side wall, such cylindrical side wall being symmetrically spaced from the drawn work product central longitudinal axis which is perpendicular to the geometric center of such planar end wall, controlling relative movement between such draw punch and draw die so as to provide unitary flange metal extending radially outwardly with respect to such central longitudinal axis around the periphery of such open end of the drawn work product, such flange metal lying in a plane which is substantially normal to the central longitudinal axis of the drawn work product, and disposing such drawn work product for movement from such blanking and cupping station with its closed end wall in such sheet metal travel path; then pneumatically moving such drawn work product while separating the travel path of the scrap sheet metal from which a blank has been cut from the travel path of the drawn work product to direct such work product onto a work product can line for controlled movement toward a redraw station, electrostatically lubricating interior and exterior surfaces of the drawn work product before redrawing while such work product is being controllably moved along such work product can line; and thereafter carrying out a redraw operation on such lubricated cup-shaped work product to decrease the diameter of its closed end wall and increase the height of its unitary side wall to form a redrawn cup, such redrawing operation being carried out while such work product is oriented closed-end up utilizing simultaneous movement in opposite directions along such central longitudinal axis of a redraw punch and a redraw die defining a redraw cavity into which such work product is redrawn, controlling movement of such redraw punch and redraw die along such central longitudinal axis during such redrawing operation to present flange metal at the open end of such redrawn cup, such flange metal extending radially outwardly at the open end of such redrawn cup in a plane which is normal to the central longitudinal axis of such redrawn cup, such flange metal at the open end of such redrawn cup being disposed in such work product line at completion of such redraw operation; and moving such redrawn cup from such redraw station closed-end up with such redrawn flange metal disposed in such work product can line.

2. The process of claim 1 in which such drawn work product after such blanking and cupping operation is pneumatically moved along the sheet metal travel path to a position over an opening in the sheet metal previously formed by cutting such blank for such drawn work product from such sheet metal, then pneumatically moving the drawn work product downwardly through such blank opening to work product conveyance means located vertically beneath such sheet metal travel path, such conveyance means forming part of such work product can line.

3. The method of claim 1 or 2 including inverting such open-end up drawn work product before such redraw step to closed-end up orientation by transfer between conveyor means located in such work product line leading to such redraw station for movement along such work product line on such flange metal presented by work product.

4. The process of claim 1 or 2 including a plurality of redraw operations, each such redraw operation being carried out with closed-end up orientation of a cup-shaped work product, and with electrostatic lubrication of both internal and external surfaces of such work product being carried out prior to each such redraw operation while such work product is being controllably moved along such work product can line.

5. The method of claim 1 or 2 in which such redraw operation comprises a final redraw and such redraw punch presents an elongated cylindrical configuration side wall symmetrically disposed in relation to its centerline axis, a working end wall at its upwardly oriented longitudinal end, and a transition zone of curvilinear configuration in radial cross section joining such working end wall and side wall of such redraw punch, such redraw punch working end wall including a countersunk end wall panel portion located radially inwardly of such transition zone;

such final redrawing operation being carried out by moving such redraw punch into the open end of such cup-shaped work product along a path in which the centerline axes of the redraw punch, redraw cavity and the cup-shaped work product are coincident while clamping sheet metal which is peripherally external of such redraw cavity, such clamping action being limited to clamping sheet metal between opposed planar surfaces during such redraw with, such unitary flange metal at the open end of the redrawn cup being between such opposed planar clamping surfaces as such redraw is being completed, then releasing clamping action on such flange metal as such male redraw punch approaches top dead center of its upward stroke, and then countersinking the closed end wall of such redrawn cup by continued upward movement of such redraw punch causing its working end wall to coact with stationary male profiling means to countersink an end wall panel portion of the closed end wall of such redrawn cup into recessed relationship to the periphery of such redrawn cup at its closed end.

6. The method of claim 5 further including moving such final redrawn cup from such redraw apparatus oriented closed end up with such redrawn flange metal disposed in such work product line, and carrying out the following steps in-line:

trimming such redrawn flange metal to a uniform diameter, and impressing sheet metal reinforcing beading in the side wall of such redrawn cup.

* * * * *